US005766428A

United States Patent [19]

Iida

[11] Patent Number: 5,766,428

[45] Date of Patent: Jun. 16, 1998

[54] CHROMIUM PLATING SOLUTION, SOLUTION WASTE FROM CHROMIUM PLATING AND CLOSED RECYCLING SYSTEM FOR CHROMIC ACID CLEANING WATER IN CHROMIUM PLATING

[75] Inventor: Hideomi Iida, Hokkaido, Japan

[73] Assignee: Nichiei Hard Chrome Industrial Company, Hokkaido, Japan

[21] Appl. No.: 759,526

[22] Filed: Dec. 5, 1996

[30] Foreign Application Priority Data

Dec. 15, 1995 [JP] Japan ..... 7-327367

[51] Int. Cl.[6] ..... C25B 15/08; C25D 21/18; C25D 21/20; C25C 1/10

[52] U.S. Cl. ..... 204/238; 204/240; 204/276; 204/278; 204/DIG. 13

[58] Field of Search ..... 204/238, 240, 204/276, DIG. 13, 278

[56] References Cited

U.S. PATENT DOCUMENTS

| | | | |
|---|---|---|---|
| 2,439,491 | 6/1948 | Schiffl | 204/277 |
| 3,481,851 | 12/1969 | Lancy | 204/180 |
| 3,661,732 | 5/1972 | Withrow | 204/51 |
| 3,681,212 | 8/1972 | McKissick | 204/51 |
| 3,761,381 | 9/1973 | Yagishita | 204/238 |
| 3,839,180 | 10/1974 | Takayasu | 204/238 |
| 3,985,628 | 10/1976 | Myers | 204/14 R |
| 4,006,072 | 2/1977 | Takayasu | 204/238 |
| 4,157,942 | 6/1979 | Tuznik et al. | 204/35 R |
| 5,178,746 | 1/1993 | Darnall et al. | 205/287 |
| 5,200,055 | 4/1993 | Zitho | 205/94 |
| 5,223,119 | 6/1993 | Davies | 205/94 |
| 5,246,559 | 9/1993 | Bishara et al. | 204/232 |

FOREIGN PATENT DOCUMENTS 7211838 3/1974 Netherlands .

OTHER PUBLICATIONS

European Search Report and Annex, Apr. 1997.

Chemical Abstracts, vol. 100, No. 10, Abstract No. 76319q, p. 510, XP002029192, Mar. 5, 1984.

*Primary Examiner*—Kathryn L. Gorgos

*Assistant Examiner*—Chrisman D. Carroll

*Attorney, Agent, or Firm*—Greenblum & Bernstein P.L.C.

[57] ABSTRACT

Closed recycle system for chromium plating solution, solution wastes from chromium plating and chromic acid cleaning water in chromium plating composed of a chromium plating chamber including a chromic acid mist recovery device in communication with a recovery vessel for recovering and liquefying chromic acid mists formed upon chromium plating, and a chromic acid mist cleaning tower in communication with the recovery vessel for cleaning chromic acid mists flowing from the chromic acid mist recovery device. The recovery vessel is preferably positioned underground, and also preferably positioned in the recovery vessel. Liquid wastes containing noxious substances formed in chromium plating factories are utilized, and generation of materials leading to public pollution is prevented.

5 Claims, 4 Drawing Sheets

CHROMIUM PLATING SOLUTION, SOLUTION WASTE FROM CHROMIUM PLATING AND CLOSED RECYCLING SYSTEM FOR CHROMIC ACID CLEANING WATER IN CHROMIUM PLATING

BACKGROUND OF THE INVENTION

1. Field of the Invention

The present invention concerns improvements in treatment apparatus for chromium plating solution, solution wastes from chromium plating and chromic acid cleaning water in chromium plating.

2. Description of Related Art

Treating techniques for chromium plating solution, solution wastes from chromium plating or the like are generally classified into the following three types:

(1) Hexavalent chromium is reduced into trivalent chromium ($Cr^{3+}$) by various kinds of reducing means and then precipitating to remove the same as chromium hydroxide by an alkaline chemical.

(2) Chromates with less solubility, such as barium salt ($BaCrO_4$) or lead salt ($PbCrO_4$), in metal chromates are formed and removed by precipitation.

(3) Chromic acid is recovered by ion exchange techniques, that is, by using free base type or strongly basic anion exchange resins.

Among the treating techniques described above, the second method of forming insoluble chromates is hardly utilized at present since barium salt and lead salt are expensive and toxic. Also, a stoichiometrically exact addition amount is required, with the addition amount having to be changed in accordance with the fluctuation of discharged liquid, flow rate and chromic acid concentration, thereby causing various problems from a view point of operation control.

The third technique of using ion exchange requires control of the upper limit of the chromic acid concentration and desorption of strongly basic anion exchange resin upon treating discharged chromic acid solution. When hexavalent chromium is reduced into trivalent chromium after pH adjustment and chemicals are added, chromium hydroxides are formed and precipitated to form wastes, which result in public pollution.

In each of the treating techniques described above, reduction and neutralization are applied to form sludges, which are treated so as not to violate legal regulations defining poisons and deadly chemicals.

Under such circumstances, various costs, including installation costs, chemical costs for detoxifying treatment and treating costs for public pollution (sludge treating costs) are enormous. In addition, highly skilled techniques are required for the operation control, often going beyond the cost bearing performance and technical faculty of minor enterprises.

It is accordingly an object of the present invention to overcome the foregoing problems in the prior art, to provide for the convenient and economically effective utilization of liquid wastes containing toxic materials formed in a great amount, for example, in chromium plating factories, to establish a closed recycle system for an entire chromium plating process through elimination of public pollution, and to provide resource and energy saving, and to prevent formation of materials leading to public pollution.

SUMMARY OF THE INVENTION

The foregoing object can be attained in accordance with the present invention by providing, in a chromium plating chamber for conducting chromium plating operations, a recovery vessel which does not discharge a chromium plating solution, solution wastes from chromium plating and chromic acid cleaning water out of the chromium plating chamber, a chromium plating vessel for applying chromium plating to a work to be plated, a filtering device in communication with the recovery vessel used for a chromium plating solution having strong oxidizing power, an impurity recovering electrolysis vessel in communication with the chromium plating vessel and the filtration device, respectively, for precipitating iron ions as impurities in the form of iron hydroxide by reduction and converting trivalent chromium into hexavalent chromium of chromic acid by oxidation and providing to the chromium plating chamber a chromic acid mist recovery device in communication with the chromium plating vessel for recovering and liquefying chromic acid mist formed upon chromium plating, and a chromic acid mist cleaning tower in communication with the chromic acid mist recovery device and the recovery vessel for cleaning chromic acid mists flowing from the chromic acid mist recovery device.

For constitution of a closed recycle system, construction of the recovery vessel underground of the chromium plating chamber and provision of the chromium plating vessel at the inside of the recovery vessel are preferred.

DESCRIPTION OF PREFERRED EMBODIMENTS

Figure 1:
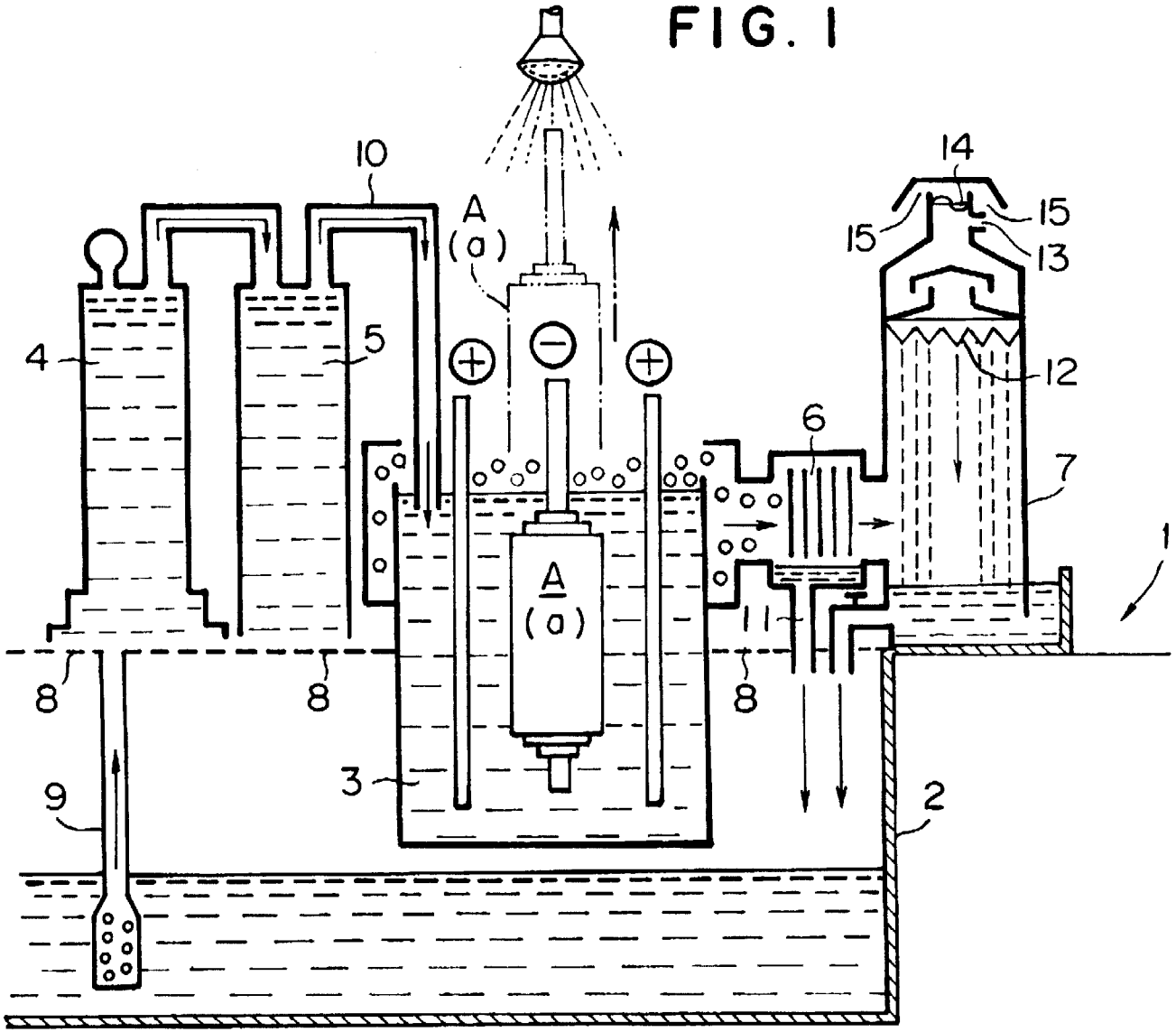
FIG. 1 is an explanatory view for a closed recycle system for use in chromium plating solution, solution waste from chromium plating and chromic acid cleaning water according to the present invention.

Preferred embodiments of the present invention will be explained with reference to FIG. 1.

A chromium plating chamber 1 for conducting chromium plating operations has various facilities required for chromium plating, such as a recovery vessel 2, a chromium plating vessel 3, a filtration device 4, an impurity recovering electrolysis vessel 5, a chromic acid mist recovery device 6 and a chromic acid mist cleaning tower 7 in which the filtration device 4, the chromic acid mist recovery device 6, the chromic acid mist cleaning tower 7 and the like are in communication with the recovery vessel 2, and the impurity recovering electrolysis vessel 5 is in communication with the chromium plating vessel 3. Further, the chromium plating vessel 3 is disposed in the recovery vessel 2, so that the chromium plating solution, the solution wastes from chromium plating and the chromic acid cleaning water are entirely recovered by the recovery vessel 2, to constitute a closed recycle system not flowing them out of the chromium plating chamber.

The recovery vessel 2 recovers the chromium plating solution, solution wastes from chromium plating and chromic acid cleaning water entirely and does not discharge them at all to the outside of the chromium plating chamber 1. An underground chamber constructed to the chromium plating chamber 1 is used as the recovery vessel 2.

The recovery vessel 2 has a water permeable lid 8 (for example, grating) at an opening portion so that the chromium plating solution, the solution wastes from chromium plating and chromic acid cleaning water leaked to the inside of the chromium plating chamber 1 are recovered.

The chromium plating vessel 3, which is disposed in the recovery vessel 2, is provided for applying chromium plating to the article "a" to be plated (hereinafter also referred to as a plated article "A"), which is disposed in the recovery vessel 2. By the disposition in the recovery vessel 2, if a chromium plating solution leakage accident should occur, the leaked solution can be recovered in the recovery vessel 2. Also, aqueous chromic acid, formed upon raising of the chromium plated article A in the chromium plating vessel 3 and washing by shower, can be recovered to the recovery vessel 2.

The chromium plating vessel 3 is disposed in the recovery vessel 2 at a lower position to enable a large sized plated article "a", a heavy weight plated article "a", or a large and heavy weight plated article "a" to be easily put into and taken out of the chromium plating vessel 3, as compared to the chromium plating vessel 3 being provided above the ground. Also, operators can conduct chromium plating operation safely on the ground without climbing up to a high place to achieve chromium plating, thereby contributing to ensurance of safety in the plating operation.

Since chromium plating is conducted by electrolysis, chromium plating is conducted by disposing an anode at a vacant opposed portion in the space in the chromium plating vessel 3 and putting the plated article "a" between the electrodes.

The filtration device 4 is used for separation by filtration of solid suspended matters (1.7 to 7.0μ grain size) contained, for example, in the chromium plating solution, solution wastes from chromium plating and chromic acid cleaning water in the recovery vessel 2. The device sucks the chromium plating solution, the chromic acid cleaning water, the solution wastes from chromium plating and the like in the recovery vessel 2 by way of a suction tube 9, filters solid suspended matters through a filtration cylinder disposed at the inside (not illustrated) and then sends them for the removal of impurities into the impurity recovering electrolysis vessel 5.

Figure 3:
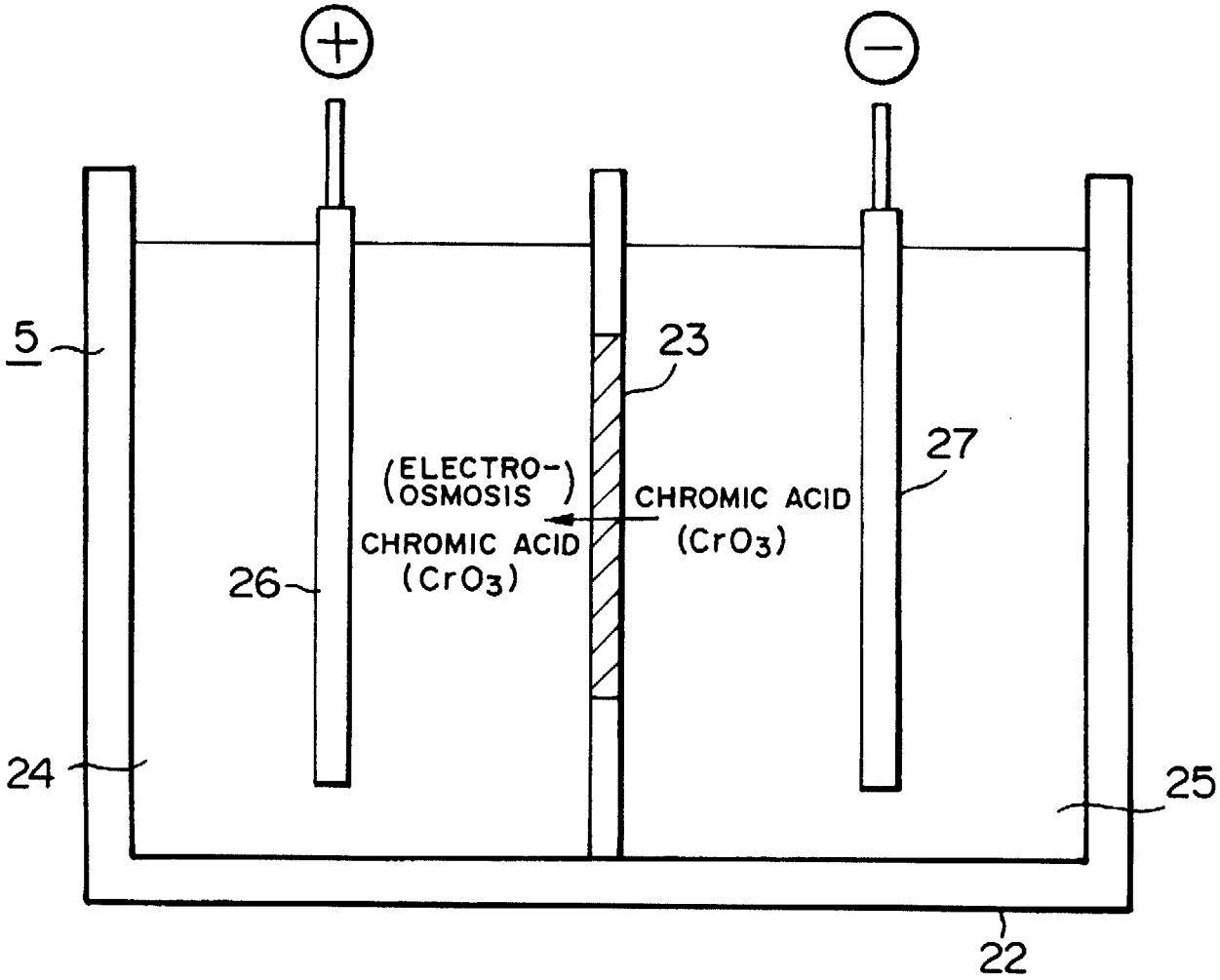
FIG. 3 is a schematic explanatory view for the inside of an impurity recovering electrolysis vessel.

The impurity recovering electrolysis vessel 5 is used mainly for reducing and precipitating to remove impurities (for example, ions of metals such as iron, copper or zinc and trivalent chromium). It has a structure as shown in FIG. 3 in which a vessel 22 itself is formed as a double walled vessel comprising an outer vessel and an inner vessel. The outer vessel is made of iron and lined with a front sheet, while the inner vessel is made of a rigid vinyl chloride resin. The inside of the inner vessel is partitioned with a partition membrane 23 into an anode chamber 24 and a cathode chamber 25.

The impurity recovering electrolysis vessel 5 has positive and negative bus-bars in the upper portion of the vessel 22 itself, from which a lead alloy anode 26 and iron cathode 27 are suspended and opposed to each other by way of the partition membrane 23.

Liquids after separation of solid suspended mattes by filtration, including chromium plating solution, solution wastes from chromium plating and/or chromic acid cleaning water, are transferred from the filtration vessel 4 to the anode chamber 24 and the cathode chamber 25, respectively. When electrolysis is started, three types of reactions proceed in parallel with each other to form a chromic acid (hexavalent chromium) regeneration solution with less impurity and at a high concentration.

That is, when electrolysis is started in the anode chamber 24 and the cathode chamber 25, electro-osmosis or electrodialysis of chromic acid occurs from the cathode chamber 25 to the anode chamber 24 passing through the permeation membrane 23, in which dialysis of chromic acid and electrolytic oxidation or trivalent chromium ($Cr^{3+}$) into chromic acid ($Cr^{3+} \rightarrow CrO_3$) proceeds in the anode chamber 24 and, as a result, the concentration of chromic acid in the anode chamber 24 is increased and the amount of trivalent chromium is decreased. Thus, a regenerated solution which can be used as it is as the chromium plating solution can be obtained upon completion of the electrolysis.

On the other hand, in the cathode chamber 25 of the impurity recovering electrolysis vessel 5, metal ions of impurities (metal ions such as of iron, copper and zinc) are precipitated as hydroxides and removed.

The chromium acid mist recovery device 6 is a dry type device which is intended for recovering and liquefying formed chromic acid mists with oxygen and hydrogen generated upon electrolysis of chromium plating and transferring the mists to the recovery vessel 2.

Figure 4:
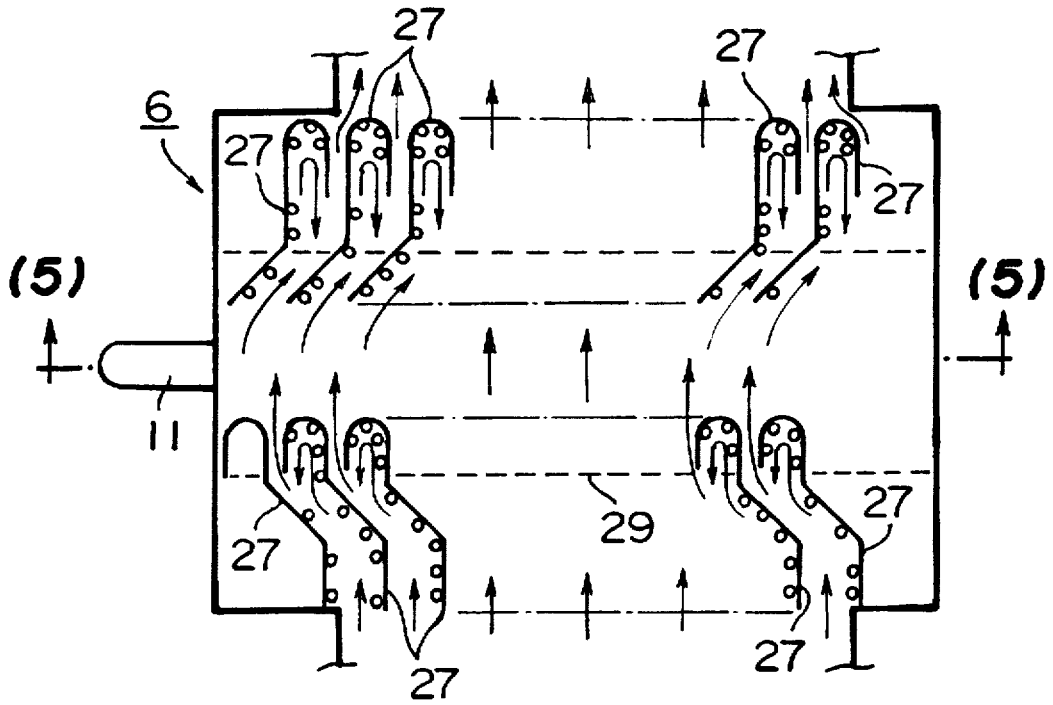
FIG. 4 is a schematic explanatory plan view for the inside of the chromic acid mist recovery device.
Figure 5:
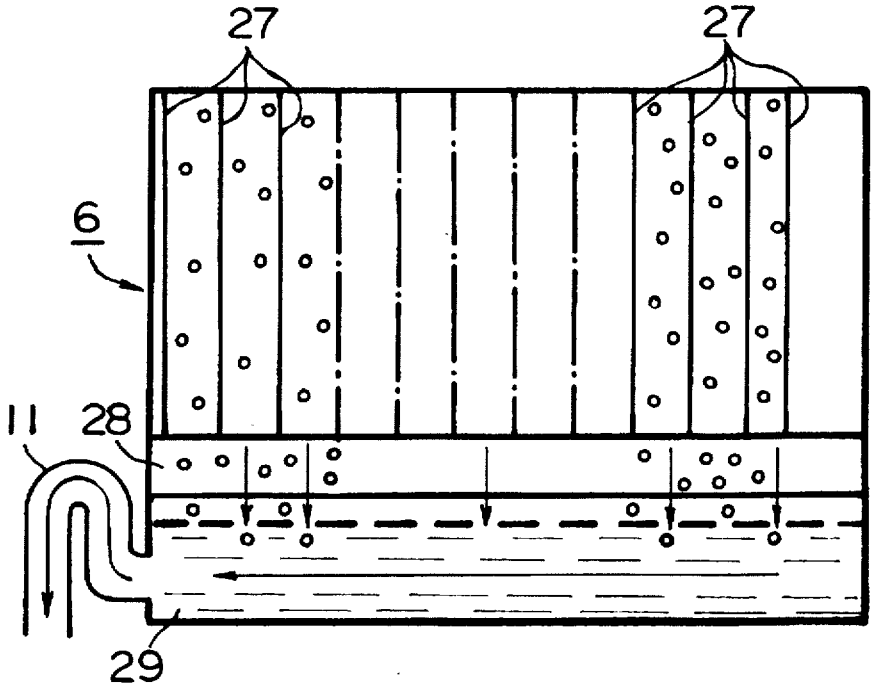
FIG. 5 is a cross sectional view taken along line (5)—(5) in FIG. 4.

In the inner structure of the dry chromic acid mist recovery device 6, as shown in FIGS. 4 and 5, a plurality of chromic acid mist liquefying plates 27 each at 45° relative to the flowing direction of the chromic acid mists are arranged in the vertical direction. When the chromic acid mists collide against the plates by inertia and rotational force, the mists are liquefied and deposited and flow along the liquefying plate and are collected by the collecting grooves 28 and then flow as the chromic acid solution from the recovery liquid receiving vessel 29 by way of the flowing tube 11 to the recovery vessel 2.

The size of the chromic acid mist recovery device 6, as well as the size and number of the chromic acid mist liquefying plates 27 may be changed depending upon the amount of the mists.

The chromic acid mist liquefying plate 27 is constituted, not by disposing a flat plate at an angle of 45° relative to the flowing direction of the chromic acid mists, but by bending one end of a plate member into a generally U-shape, bending the other end at an angle of 45° and further bending at an angle of 45° substantially in parallel with the U-shaped portion. The thus fabricated plate members are disposed each by an equal number on the mist inlet (portion of the chromic acid mist recovery device receiving materials from the chromium plating vessel) and the mist exit (portion of the chromic acid mist recovery device forwarding materials to the chromic acid mist cleaning tower) and in vertically opposed directions in the device main body.

The chromic acid mist cleaning tower 7 is a wet type device which is used for the purpose of cleaning to remove the chromic acid mist which cannot be liquefied in the dry chromic acid mists recovery device 6.

The chromic acid mist cleaning tower 7 has such a structure in which a shower 12 is disposed in the upper portion of the tower, a chromic acid discharging concentration measuring/inspection hole 13 is perforated at a duct intermediate portion above the shower and a discharge blower 14 is disposed above the inspection hole, and a discharge window 15 is opened above the discharge.

When the chromic acid mist cleaning tower 7 is constituted as described above and the discharge blower 14 is operated, the chromic acid mists that cannot be liquefied by the dry chromic acid recovery device 6 are sucked into the chromic acid mist tower and cleaned and removed into the recovery vessel 2 by the cleaning water injected from the shower 12.

Referring to the cleaning water for the shower 12 of the chromic acid mist cleaning tower 7, the concentration of chromic acid in air discharged from the cleaning tower is measured by a discharged chromic acid concentration measuring/inspection hole 13 and then old cleaning water is discharged to the recovery vessel 2 and replaced with fresh cleaning water before the measured value shows a standard value determined by the environmental criterion, so that the cleaning and eliminating efficiency for the chromic acid mists is not lowered.

The concentration of the chromic acid is measured by utilizing the discharged chromic acid concentration measuring/inspection hole 13 by capturing a liquid in air sucked by the blower 14 in a collecting device (collection time for about 20 min, sucking flow rate of 3.0 l/min) and inspected by an atomic absorption photometer.

On the other hand, detoxified air, after cleaning and elimination of chromic acid mists, is discharged from the discharge window 15.

As described above, the chromic acid mists generated during chromium plating are recovered into the recovery vessel 2 by the combined use of a dry type eliminating apparatus and recycling of cleaning water by the wet removing apparatus, while minimizing the amount of water used and at a numerical value determined by the environmental criterion.

Chromium plating product "A" prepared by applying chromium plating to a work "a" is pulled up from the chromium plating vessel 3 after the end of the chromium plating, washed with shower above the plating vessel, removed with electrodes and coating in the chromium plating chamber 1, washed with shower again to remove chromium plating solution and then delivered out of the chromium plating chamber 1. Aqueous chromic acid formed by water washing above the chromium plating vessel 3 by the shower is recovered to the recovery vessel 2.

Description will be made to a temperature control closed recycling system for the chromium plating solution used in the chromium plating described above with reference to FIG. 2.

In the recycling system, a circulation type heating/cooling tube 16 and a temperature sensor 17, used for temperature control of the chromium plating solution, are attached in the chromium plating vessel 3. The heating/cooling pipe 16 is connected by way of two direction switching solenoid valves 18-1, 18-2 to well known heat pump 19, cooling water tank 20 and a heat accumulation vessel 21. A pipe line is formed from the heat pump 19 by way of the pump P1 to the cooling water vessel 20, while a pipe line is formed by way of another pump P2 to the heat accumulation vessel 21. Also, a heat accumulation vessel temperature sensor 30 is disposed for the heat pump 19 and the heat accumulation vessel 21.

The operation of the closed recycle system as follows.

The liquid temperature in chromium plating is detected by the temperature sensor 17 which is set to an optimum temperature required for chromium plating, and the direction switching solenoid valve 18-1 or 18-2 switches the flow to either cold water or warm water depending upon the temperature. The operation of the direction switching solenoid value 18-1 or 18-2 is conducted by a signal from the temperature sensor 17 that detects the temperature of the chromium plating solution.

Figure 2:
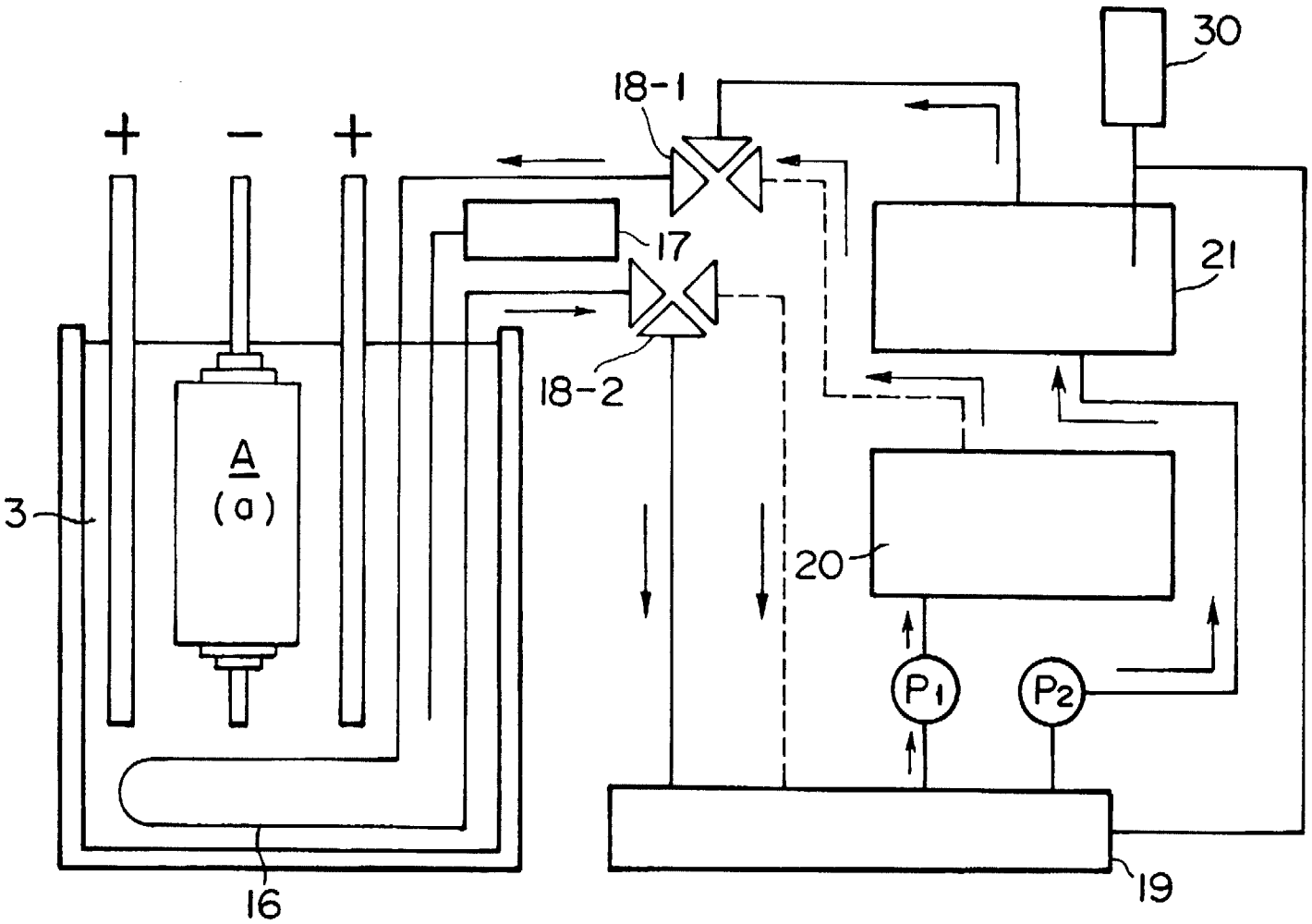
FIG. 2 is an explanatory view for a closed recycle system with temperature control for the chromium plating solution.

When the temperature of the chromium plating solution is elevated above a predetermined temperature, cold water (at 15° C.) flows by the actuation of the pump P1 from the cold water vessel 20 by way of the direction change solenoid valve 18-1 to the heating/cooling tube 16 (refer to dotted line and dotted chain in FIG. 2). Warmed water formed from cooling water warmed by the chromium plating solution and returned is sent by way of the heat pump 19 to a predetermined set temperature of cold water (15° C.) and sent to the cold water vessel 20 by the pump P1, and separated warm water and heat are accumulated by the pump P2 in the heat accumulation vessel 21.

If the temperature of the chromium plating solution falls lower than the set temperature, warm water flowing to the heating/cooling tube 16 is switched to the warm water from the heat accumulation vessel 21 sent from the cold water vessel 20 by the direction change solenoid valve 18-1 by the detection of the temperature sensor 17, the warm water flows in the heating/cooling tube 16 to elevate the temperature of the chromium plating solution. Then, with the other direction switching solenoid valve 18-2, the cold water circuit is switched to a warm water returning heat pump circuit for sending warm water to the heat pump 19.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope and spirit of the invention as defined by the appended claims.

What is claimed is:

1. A closed recycle system for chromium plating solution, solution wastes from chromium plating and chromic acid cleaning water in chromium plating composed of a chromium plating chamber for conducting a chromium plating operation, comprising:

recovery vessel for receiving and circulating within a closed system at least one of chromium plating solution, solution wastes from chromium plating and chromic acid cleaning water;

chromium plating vessel for applying chromium plating to an object work to be plated;

filtering device in communication with the recovery vessel for treating a chromium plating solution having oxidizing power, impurity recovering electrolysis vessel in communication with said chromium plating vessel and said filtration device, respectively, for precipitating iron ions as impurities in the form of iron hydroxide by reduction and converting trivalent chromium into hexavalent chromium of chromic acid by oxidation;

chromic acid mist recovery device in communication with said recovery vessel for recovering and liquefying chromic acid mists formed upon chromium plating; and a chromic acid mist cleaning tower in communication with the recovery vessel for cleaning chromic acid mists flowing from said chromic acid mist recovery device.

2. The closed recycle system according to claim 1, wherein said recovery vessel is positioned below the chromium plating vessel.

3. The closed recycle system according to claim 1, wherein said chromium plating vessel is positioned inside of said recovery vessel.

4. The closed recycle system according to claim 1, wherein said recovery vessel is positioned underground.

5. The closed recycle system according to claim 4, wherein said chromium plating vessel is positioned inside of said recovery vessel.

* * * * *